United States Patent [19]

Richards

[11] 4,067,666

[45] Jan. 10, 1978

[54] CONCRETE PUMPING APPARATUS

[75] Inventor: John A. Richards, Santa Ana, Calif.

[73] Assignee: Whiteman Manufacturing Company, Pacoima, Calif.

[21] Appl. No.: 706,497

[22] Filed: July 19, 1976

[51] Int. Cl.[2] ..... F04B 25/00; F16J 1/00

[52] U.S. Cl. ..... 417/265; 92/129; 417/900

[58] Field of Search ..... 417/265, 214, 900, 471; 92/13.3, 129

[56] References Cited

U.S. PATENT DOCUMENTS

| | | | |
|---|---|---|---|
| 2,064,750 | 12/1936 | Hurst | 417/214 |
| 2,350,678 | 6/1944 | Grimsley | 92/129 |
| 2,384,783 | 9/1945 | Longenecker | 417/900 |
| 2,448,104 | 8/1948 | Longenecker | 417/900 |
| 2,544,805 | 3/1951 | Pilch | 92/129 |
| 3,172,363 | 3/1965 | Bennett et al. | 417/900 |
| 3,279,383 | 10/1966 | Smith | 417/900 |
| 3,311,065 | 3/1967 | Hagar | 417/265 |
| 3,545,896 | 12/1970 | Zahradnik | 417/471 |
| 3,647,325 | 3/1972 | Johnson | 417/900 |
| 3,994,631 | 11/1976 | Hosteffer | 417/900 |

FOREIGN PATENT DOCUMENTS

| | | | |
|---|---|---|---|
| 845,232 | 8/1960 | United Kingdom | 92/13.3 |

*Primary Examiner*—William L. Freeh
*Attorney, Agent, or Firm*—Whann & McManigal

[57] ABSTRACT

Concrete pumping apparatus of the positive displacement type in which primary and secondary pumping units are actuated in a manner such that the pumping discharges from the pumping units overlap in a manner to produce a substantially constant flow delivery, the pumping units having pistons operably connected to a pivoted rocker arm having a driving connection with a main shaft, and another overriding driving connection with the main shaft which varies the driving action of the rocker arm, wherein the pivot of the rocker arm is supported on a swingable lever having its outer end operably engaged with rotatable cam means carried by the main shaft.

A manifold housing connected to the similar open ends of the cylinders of the pumping units, contains valve members for controlling the pumping operations so that one pumping unit serves as a primary unit to initially discharge the pumped material concurrently into a delivery line and into the cylinder of the other pumping unit which then operates as a secondary pumping unit to discharge its previously received material into the delivery line.

The manifold housing is further provided with access means permitting removal of the valve members for cleaning, replacement, repair, etc., without having to disassemble the manifold housing.

The apparatus also includes a hinged material delivery spout on the manifold housing with latching means which may be initially actuated to permit hinged movement of the spot to a partially opened latched position to relieve the pressurized material therein, prior to its being completely unlatched for hinged movement to a fully opened position.

18 Claims, 12 Drawing Figures

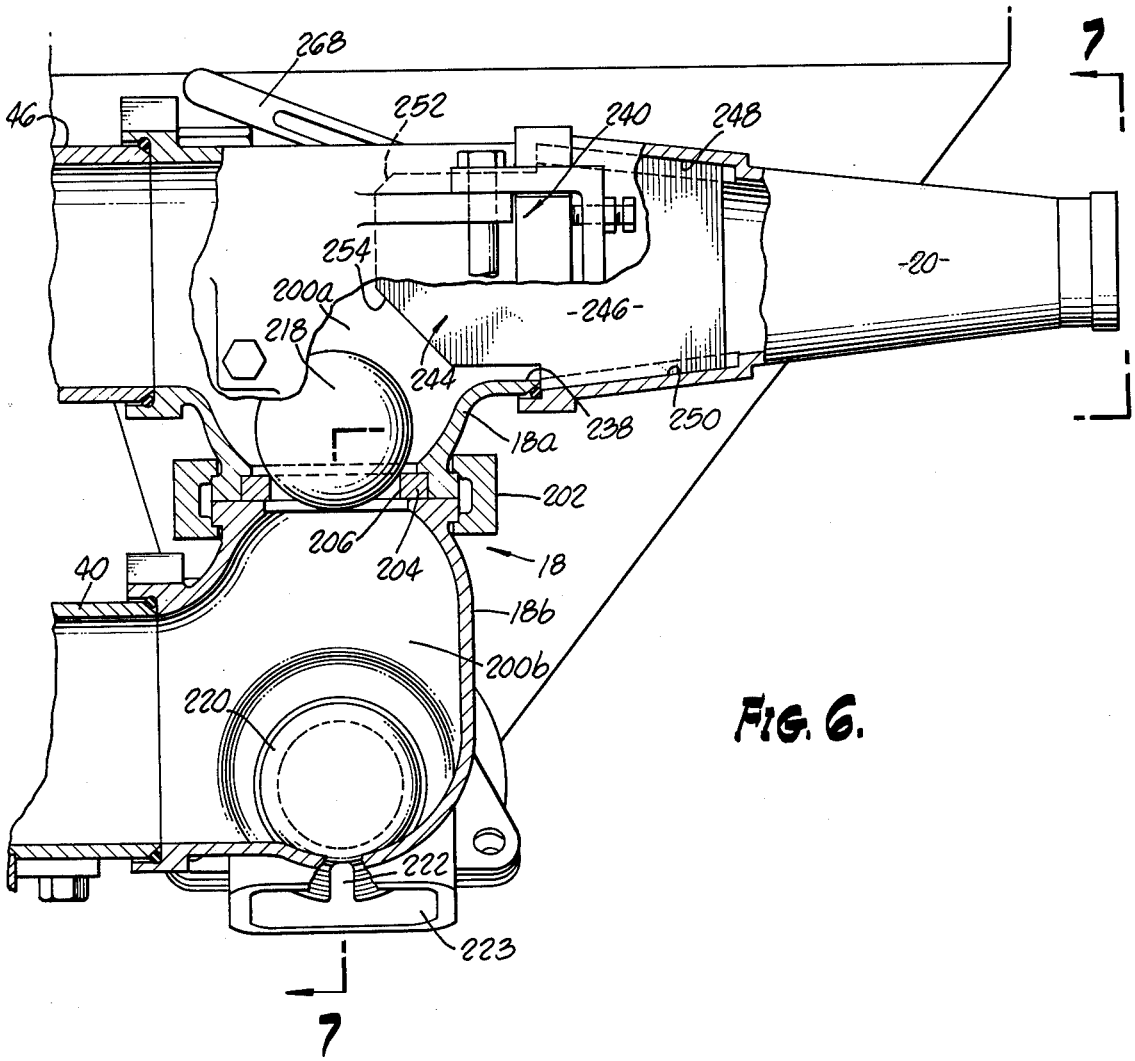
FIG. 6.
FIG. 8.
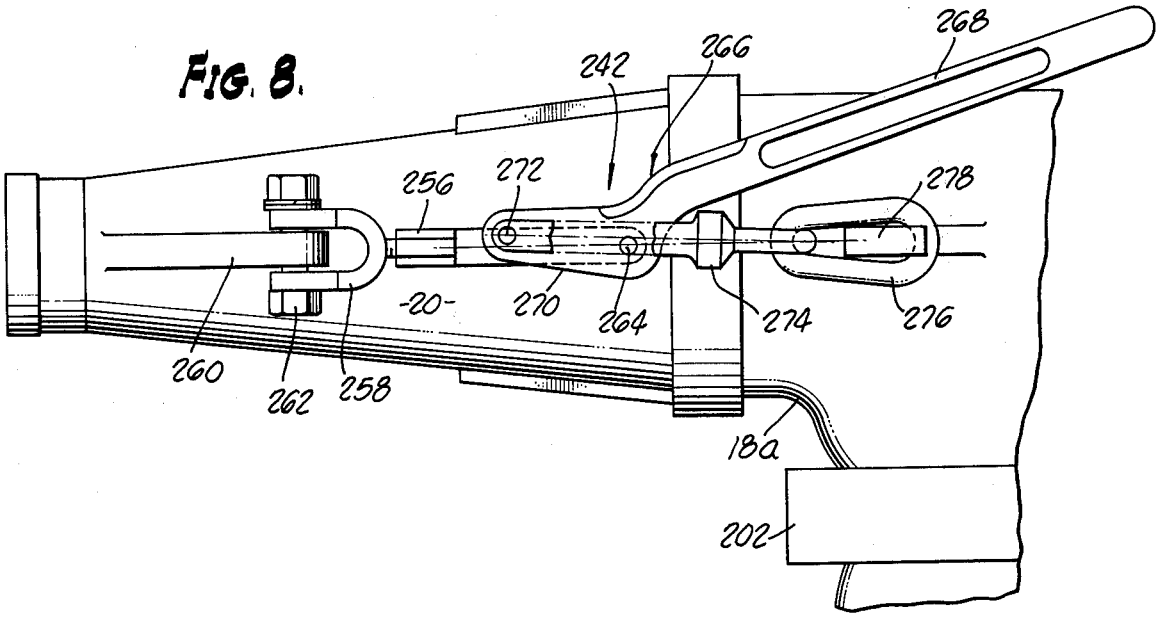

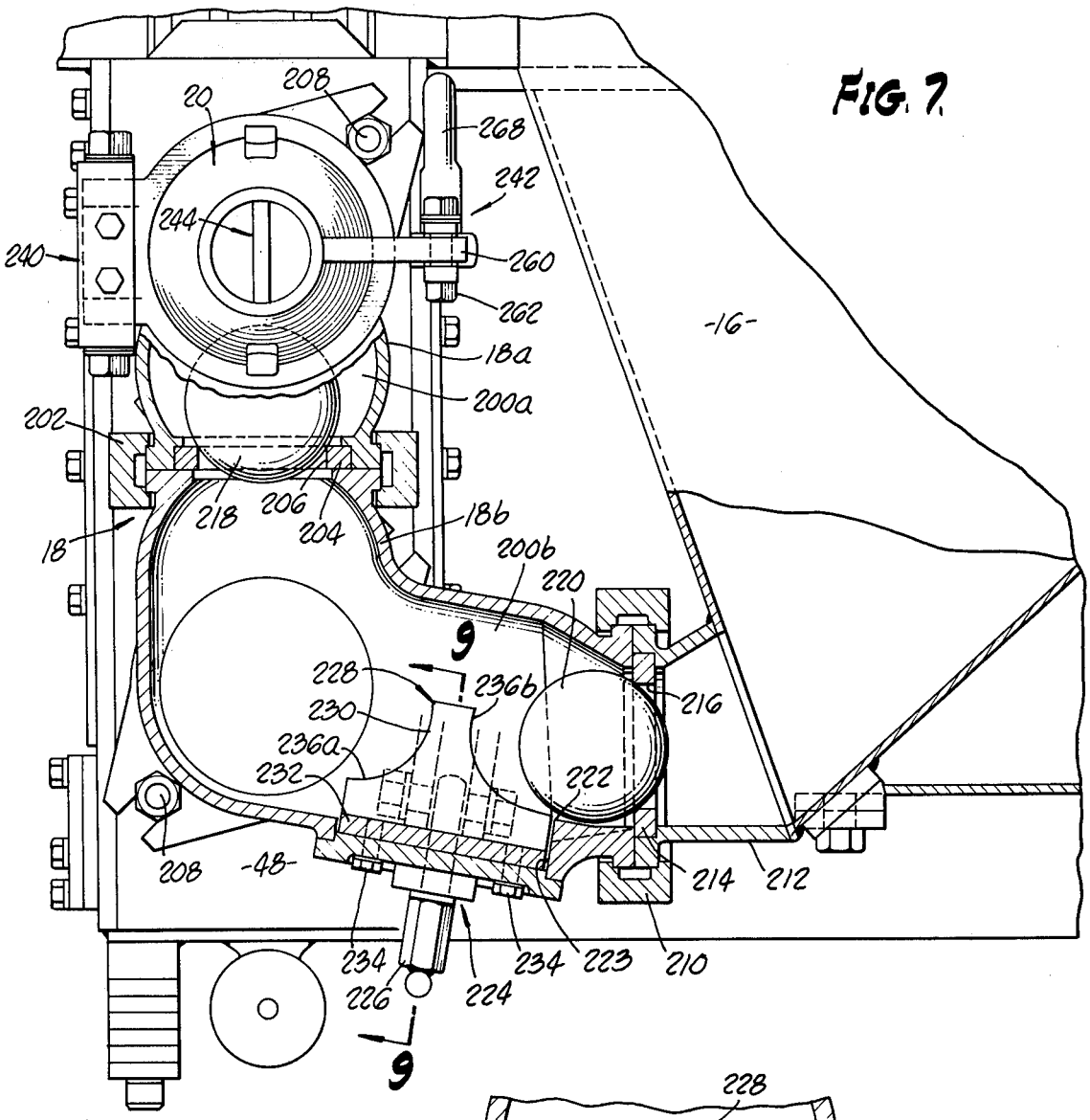
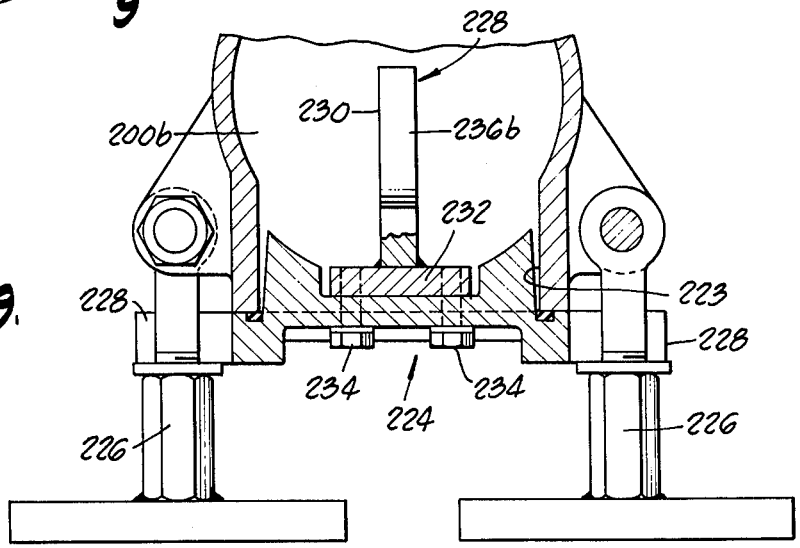
FIG. 9.

CONCRETE PUMPING APPARATUS

BACKGROUND OF THE INVENTION

The present invention relates generally to the field of pumps.

The advantageous use of positive displacement pumps, designed to operate in a manner to produce a substantially constant delivery, has heretofore been generally recognized by the construction industry and particularly for the application of cement and plaster to building surfaces by means of spray nozzles which require a relative constant rate of delivery.

A number of different pumping arrangements have been designed and manufactured with a view to obtaining pumping apparatus which would produce a substantially constant delivery of the pumped material by the use of two pumping cylinders arranged to operate in a more or less master and slave manner.

One such prior art pumping apparatus is exemplified by the structure disclosed in the Bennett, et al. U.S. Pat. No. 3,172,363, issured Mar. 9, 1965. The structure of this patent provides two pumping units which are horizontally spaced apart and driven by separate and independent driving connections from the opposite overhanging ends of the main drive shaft.

Although the apparatus of this patent, as well as others of the prior art, is successful in that a substantially constant flow of material is produced, the heretofore known arrangements have a physical arrangement of the pumping units such that many problems arise, including excessive wear of bearings and other parts, lack of easy accessibility to valve parts for replacement, cleaning, and the like, absence of safety-features, lack of compactness, inability to operate dependably for long periods of time, as well as others which still await a successful solution.

Accordingly, the present invention is concerned more particularly with a new and improved design of pumping apparatus in which many of the inherent problems of the prior art structures have been solved. One important distinction of the pumping apparatus of the present invention over that of the usual prior art arrangement, resides in the placement of the pumping units in vertically spaced relation with one pumping unit being positioned adjacently above the other.

Such arrangement permits the use of a balanced compact driving connection with the driving shaft in which the shaft connected components may be supported between a pair of main bearings in a manner to equalize the loading distribution in a manner that is not possible in the prior art arrangements wherein the shaft components are supported on overhanging shaft ends having a bearing support on one side only.

Also, the vertical arrangement of the pumping units allows the use of an improved compact valving arrangement in which it is possible to take advantage of the force of gravity for assisting in the movement of the valves towards their closed seated positions.

It has also been known heretofore from U.S. Pat. No. 3,639,086, issued Feb. 1, 1972, to provide a hinged discharge spout for the pumped material from a concrete pumping apparatus. The usual practice is to provide such spouts with a manually operable wedge lock or securing lug for releasably retaining the spout in its connected position and against hinged movement to an open disconnected position. The use of such securing devices in the known pumping arrangements creates a potential hazard, since release of the lug permits the spout to be forceably swung to the disconnected position by the pressurized pumped material remaining in the spout and connected delivery lines, and such uncontrolled discharge of material presents a potential possibility of injury to attending personnel.

To overcome the above mentioned hazard, the present invention utilizes a releasable latch that may be initially operated to permit only a slight disconnected hinged opening, until the pressurized material is sufficiently relieved to permit safe hinged movement of the spout to its fully disconnected position.

SUMMARY OF THE INVENTION

The present invention is more specifically concerned with the provision of improved positive displacement pumps in which operatively associated pumping units are interconnected by improved driving connection means from a common shaft in a manner such that a substantially constant flow of the delivered material will be produced.

Having in mind the inherent problems and disadvantages of the heretofore known pumping apparatus for concrete and similar materials, a number of the important objects and features of the present invention may be enumerated as follows:

It is one object of the herein described invention to provide a new and improved constant delivery pumping arrangement of the positive displacement type.

A further object is to provide pumping apparatus according to the foregoing object which is especially suited to the pumping of plaster, cement, and other abrasive materials.

A further object is to provide improved pumping means according to the herein described invention, in which the pumping units are arranged in vertically aligned relation and have coacting driving connections with a driving shaft, these connections being so disposed on the shaft as to produce driving forces which are in balanced relation and equally distributed between a pair of shaft supporting bearings.

A further object is concerned with the provision of a constant delivery, positive displacement pump, including a primary pumping unit and a secondary pumping unit, the pumping units having a common driving connection with a driving shaft, and in which an overriding driving connection with the shaft modifies the operating effect of the pumping units by the common driving connection in a manner to obtain overlapping pumping discharges from the pumping units.

A further object is to provide a constant delivery, positive displacement pump having primary and secondary pistoncylinder pumping units, and in which the piston of the secondary pumping unit is spring-loaded axially in one direction.

A further object is to provide a constant delivery, positive displacement pump which utilizes a primary pumping unit and a secondary pumping unit, and in which a unique valving means are provided for controlling the supply of material to the pumping units and delivery of the pumped material to a delivery spout, and wherein the movement of the valving members to seating positions is assisted by the force of gravity.

A further object is to provide a constant delivery displacement pumping means which includes improved valving means and means for adjustably effecting compensation for pumped materials of different consistency.

A still further object is to provide pumping means for plaster, cement, and similar materials, in which the pumped materials are delivered to a delivery spout supported for hinged movement between connected and disconnected positions, and in which the spout is retained by latching means arranged to be initially released to a second latching position which enables hinged movement to a position for relieving the pressurized material in the spout and connected line prior to movement to a fully disconnected position.

Another object is to provide pumping means for plaster, cement, and similar materials, in which the delivered pumped material is controlled by novel valving means with normally closed access openings which provide ready and easy access to the valve members for removal, cleaning, replacement, or the like, without having to disassemble the valving structure.

Yet another object is to provide improved pumping means for abrasive materials, in which the pumping units have an improved piston cup member, and a unique oiling arrangement.

Further objects and advantages of the invention will be brought out in the following part of the specification, wherein detailed description is for the purpose of fully disclosing a preferred embodiment of the invention without placing limitations thereon.

BRIEF DESCRIPTION OF THE DRAWINGS

Referring to the accompanying drawings, which are for illustrative purposes only:

FIG. 6 is a side view, partly in section, of the manifold housing means connected to the pumping units and showing the arrangement of valving components therein;

FIG. 7 is a fragmentary vertical sectional view taken substantially on line 7—7 of FIG. 6, and showing details of the connection of the manifold housing means to the supply hopper;

FIG. 8 is an enlarged fragmentary side elevational view of the connected hinged discharge spout, and showing the improved releasable mechanism therefor;

FIG. 9 is an enlarged fragmentary sectional view taken substantially on line 9—9 of FIG. 7, and showing details of an access closure means for the manifold housing;

DESCRIPTION OF A PREFERRED EMBODIMENT

Figure 1:
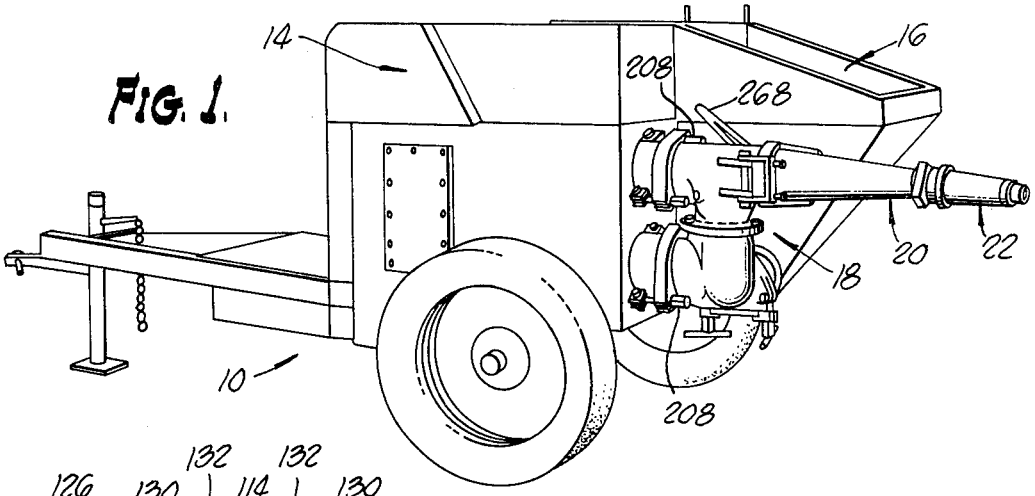
FIG. 1 is a perspective view of pumping apparatus which embodies the present invention.
Figure 5:
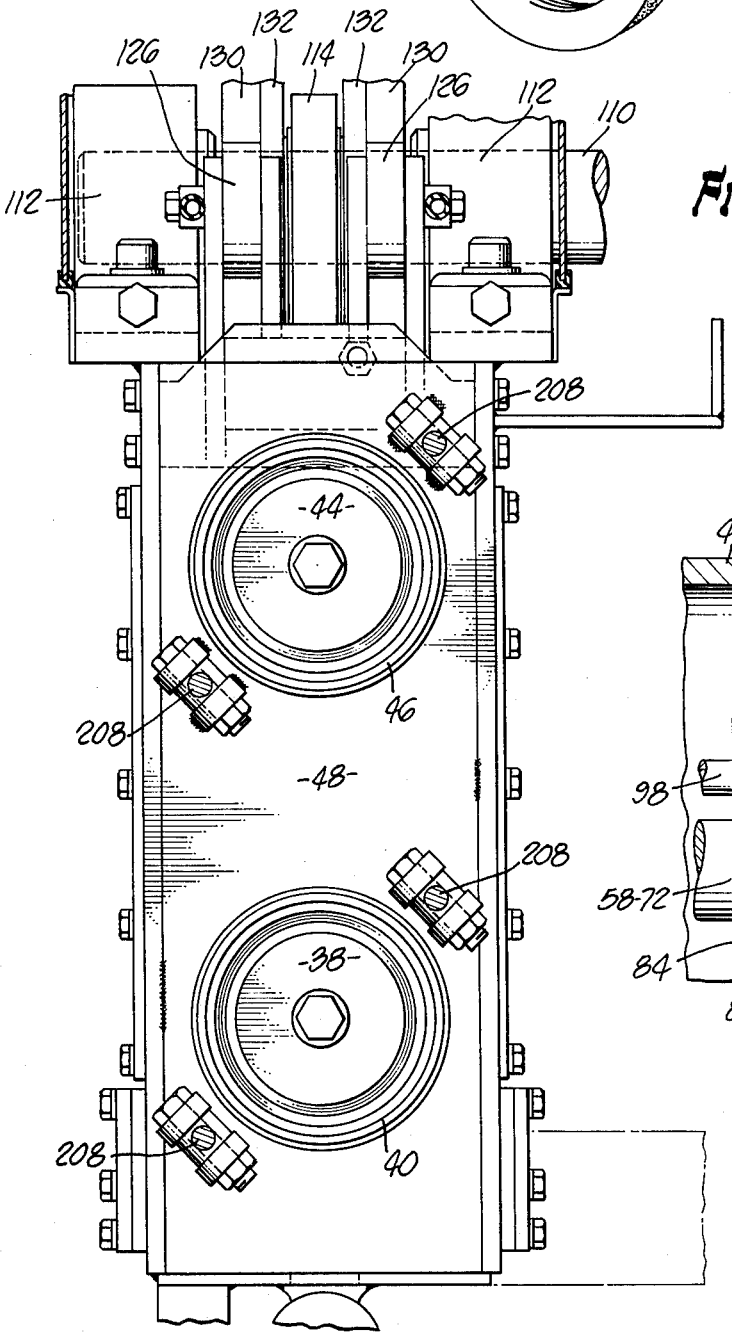
FIG. 5 is an end elevational view, with portions of the housing removed, as seen substantially along line 5—5 of FIG. 2.
Figure 2:
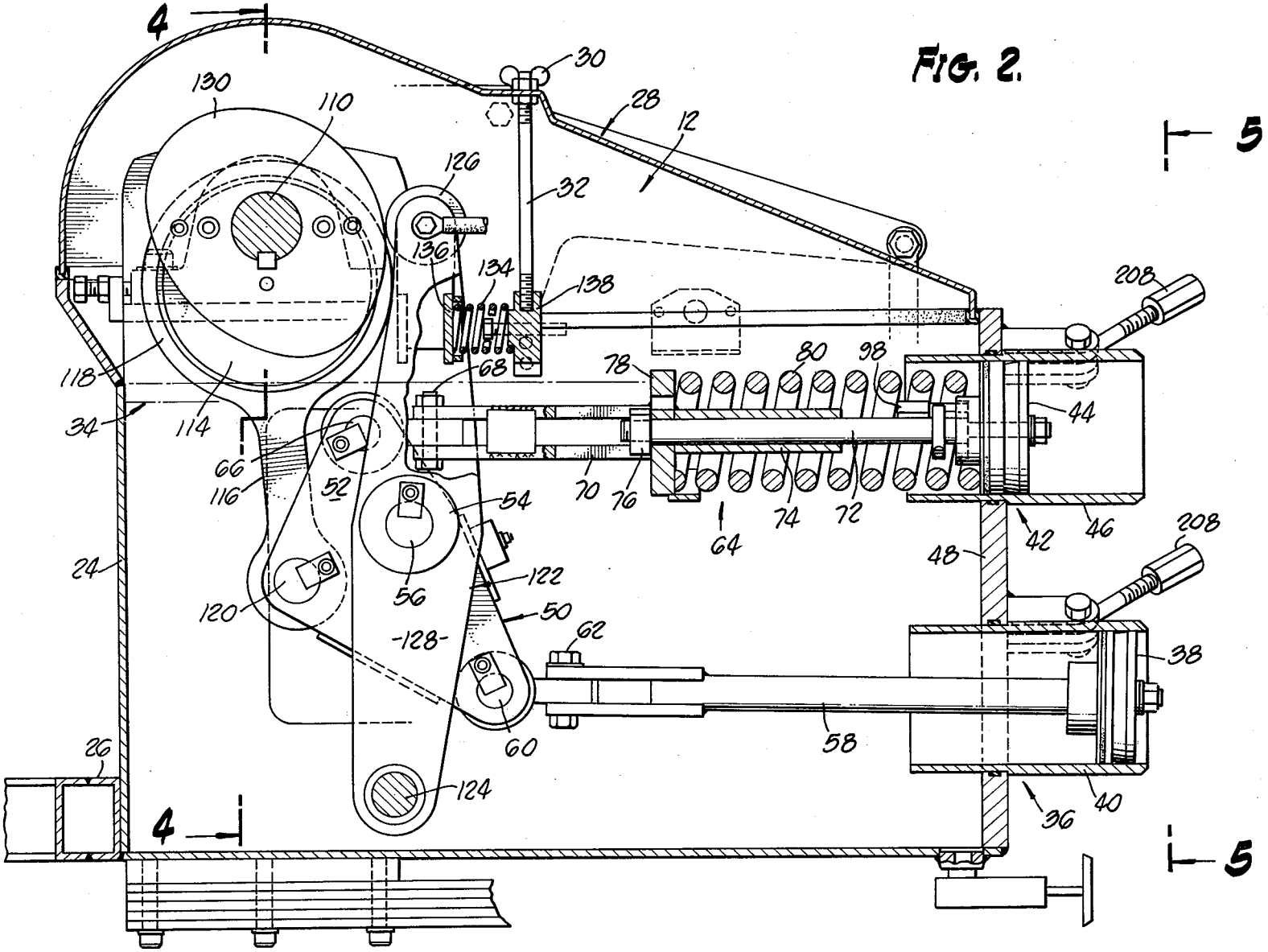
FIG. 2 is an enlarged side elevational view, partly in section, showing details of the pumping units and their driving connections.

Referring more specifically to the drawings, for illustrative purposes, the pumping apparatus of the present invention is generally indicated in FIG. 1 as being embodied in a wheeled vehicle 10 of suitable construction to provide portability of the apparatus. The pumping units and driving mechanism therefor, as generally indicated by the numeral 12, in FIG. 2, are contained within a housing closure 14 which is fabricated to provide an associated hopper 16 for the material to be pumped. The pumping units are connected with an externally mounted manifold housing structure 18 which contains the valving instrumentalities for controlling the inlet of material from the hopper 16 and the discharge of pumped material into a discharge spout 20, adapted at its outermost end for coupling connection with a delivery hose, as generally indicated by the numeral 22.

THE PUMPING MECHANISM

As best shown in FIG. 2, the pumping mechanism is mounted within the housing 14 in a tank portion 24 which is mounted upon a chassis frame structure 26 of the vehicle and provided with a removably mounted top cover 28 which is retained in position as by a thumb nut 30 having threaded engagement with a retaining rod 32. The tank 24 is utilized as an oil reservoir for the operating parts of the pumping units, and in practice would have a maintained oil level substantially at the position as indicated by numeral 34.

The pumping mechanism is comprised of a primary pumping unit 36 in which a first piston 38 is operatively associated with a first cylinder 40, and a secondary pumping unit 42 in which a second piston 44 is operatively associated with a second cylinder 46, the cylinders 40 and 46 being suitably supported in a common housing wall 48 in adjacent vertical alignment one above the other, and with their similarly positioned open ends projecting outwardly of the wall 48.

The pistons 38 and 44 are drivingly connected with a rocker arm structure 50 which is fabricated from a pair of similar triangular plate members 52, these members being secured in spaced apart relation to a common bearing sleeve 54 for receiving a pivot pin 56 upon which the rocker arm structure is supported for oscillatory movements.

The first piston 38 is mounted at one end of a piston rod 58 which is pivotally connected at its other end to one leg of the rocker arm by means of a pivot pin 60 through a right-angled pivotal connection formed by the pivot bolt 62, the pivot pin 60 and pivot bolt 62 forming in effect a universal joint connection for this end of the piston rod in order to accommodate slight tilting movements of the piston during its reciprocal movements in the cylinder 40.

In a similar manner, the second piston 44 is connected at one end of a piston rod structure, as generally indicated at 64, this structure having its other end connected to a second leg of the rocker arm by means of a pivot pin 66 through a right-angled pivotal connection formed by a pivot bolt 68 so as to thus form with the pivot pin 66 a universal joint connection at this end of the pivot rod structure. The pivot rod structure is composed of a coupling member 70 and a piston rod 72 which are connected together in axial sliding relation, the coupling member mounting an axially extending sleeve portion 74 having telescoped relation with the piston rod therein. As thus arranged, the piston rod structure is longitudinally retractable and extendable, the amount of extension being limited by a nut 76 in threaded engagement with the associated end of the piston rod, and an annular abutment 78 affixed as by welding to the coupling member 70. The piston rod structure is normally urged towards the limit of its extension by means of a compression coiled spring 80 having one end bearing against the abutment 78 and its other end bearing against the adjacent surface of the second piston 44. The purpose of this spring is to absorb pressure shocks on the piston during pumping operations. The pumping capacity of the primary pumping unit is substantially twice that of the secondary pumping unit. While the cylinders 40 and 46 are of substantially the same diameters, the piston stroke of the piston 38 is substantially twice that of the piston 44 due to the effective lever arms with respect to the rocker arm 50.

Figure 3:
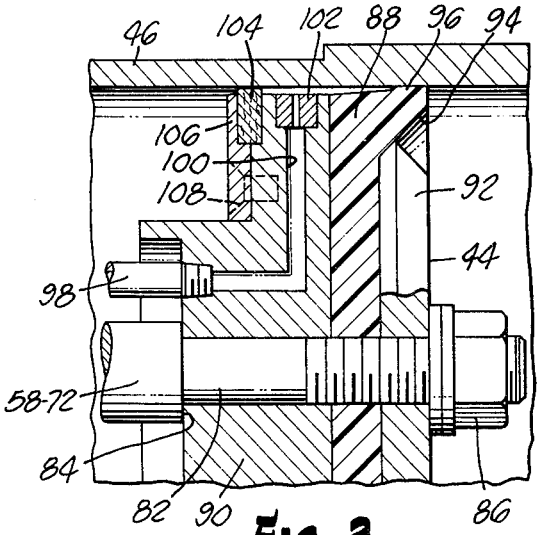
FIG. 3 is an enlarged fragmentary sectional view of the upper piston structure, as viewed in FIG. 2.

Basically, the structure of the pistons 38 and 44 is the same, and will now be described having reference to FIG. 3. As shown, the piston rod 58 or 72 is formed at its outermost end with an extension 82 of reduced diameter, this extension projecting from an annular abutment shoulder 84, and at its outermost end being threaded to receive a retaining nut 86. An annular cup member 88 of a suitable flexible material such as Neoprene or Urethane is clampingly secured between an inner annular back-up member 90 and an outer annular retainer ring 92, the retainer ring being seated in a face recess 94 of the cup member. In this arrangement, it will be noted that the outer peripheral diameter of the back-up member 90 is slightly less than the internal diameter of the associated cylinder. A feature of the construction of the cup member is that it is provided with a projecting circumferentially extending lip flange 96 having sliding engagement with the adjacent wall of the cylinder. This construction has the advantage that, during operation, the piston will be permitted to tilt slightly within the associated cylinder, as the result of the oscillating movement of the connected rocker arm 50 and form an effective oil seal.

Since the primary pumping unit 36 is positioned well below the normal oil level 34, the parts of this pumping unit will be adequately lubricated. As regards the secondary pumping unit 42, the parts of this unit will be partially below the oil level, and to avoid improper lubrication in the event that the oil level should become abnormally low, it is a feature to provide a system of forced lubrication for the piston 44 of the secondary pumping unit. For this purpose, as shown in FIG. 3, the back-up member 90 of the piston 44 is provided with a lubricant supply connection 98 having communication with one or more radially extending passageways 100 having restricted peripheral outlets 102 for the discharge of lubricant into the circumferentially extending peripheral space between the lip flange 96 and an inwardly positioned packing ring 104 of a suitable fibrous or other material, this ring being clampingly retained by means of a ring retainer 106 and suitable retaining screws 108.

Returning to FIG. 2, provision is made for oscillating the rocker arm 50 by a driving connection between a third leg of the rocker arm and a part of a main driving shaft 110 which is positioned between a pair of axially spaced main shaft supporting bearings 112. More specifically, the driving connection includes an eccentric disc 114 which is fixedly secured to the shaft for rotation therewith, and an operatively associated connecting rod 116 having a ring structure 118 at one end for sliding peripheral engagement with the eccentric disc, and a pivotal connection at its other end with the rocker arm 50 by means of a pivot pin 120.

With the rocker arm driving connection as thus far described, it will be appreciated that the primary and secondary pumping units will be alternately actuated in opposite directions, and that with such operation there would be no overlapping of the discharges from these units. Accordingly, the operating effect of the rocker arm drive is modified by an overriding driving connection in such a manner that the desired overlapping discharges will be effected.

Figure 4:
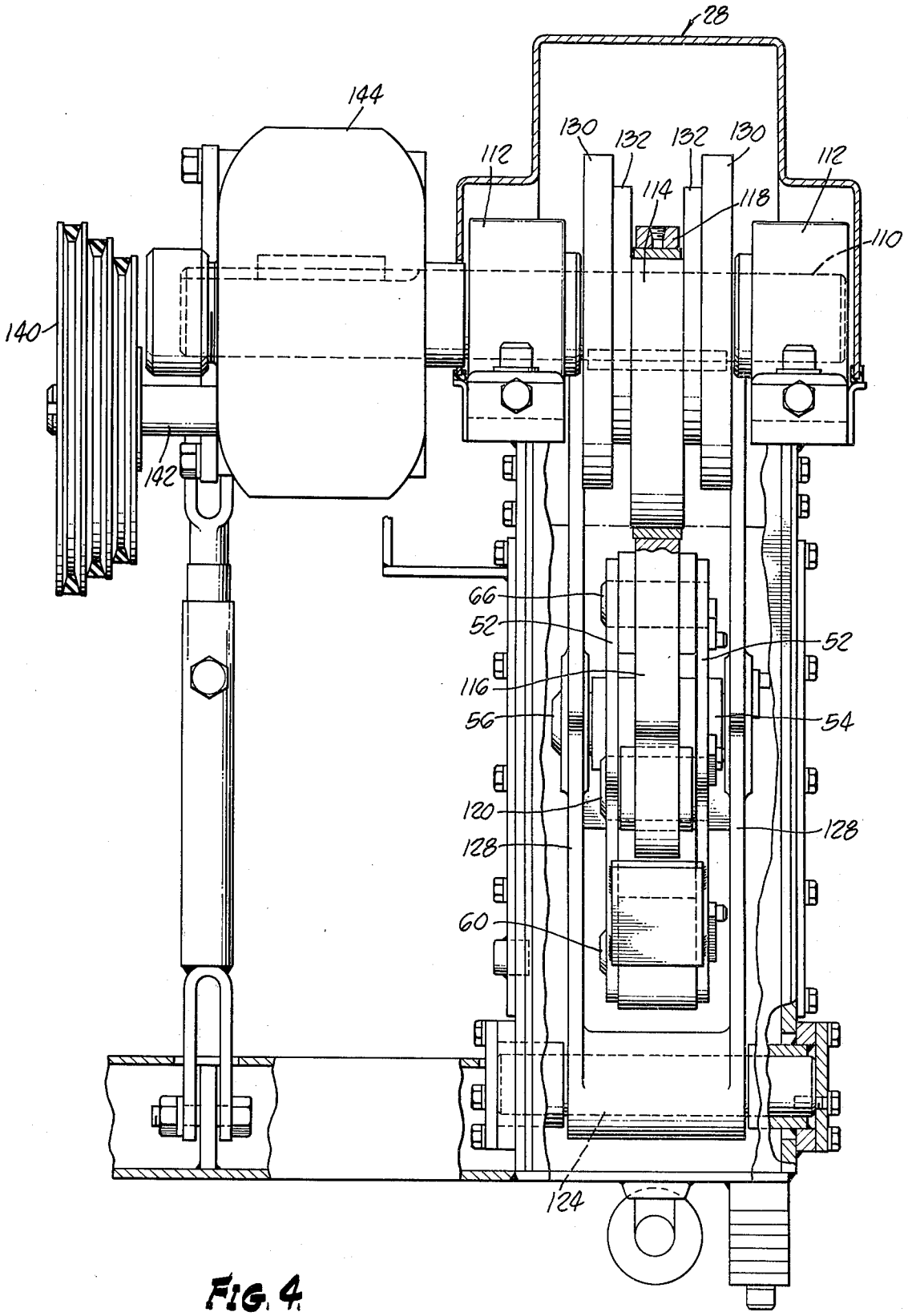
FIG. 4 is an end elevational view, partly in section, taken substantially on line 4—4 of FIG. 2, portions of the housing being cut away to disclose the internal parts.

As primarily shown in FIG. 2, the overriding driving connection is accomplished by mounting the pivot pin 56 support of the rocker arm 50 between the ends of a swingably mounted lever 122, the lower end of this lever being supported upon a fixed pivot 124. The outermost end of the lever 122 carries a pair of rollers 126. As shown in FIG. 4, it will be noted that the lever 122 is fabricated to provide similar spaced apart side members 128, and that the rocker arm structure 50 is operatively supported between these side members, the pivot pin 56 having its ends respectively supported in these plate members as is also the pivotal support for the rollers 126 at the uppermost end of the lever 122. These rollers function as cam followers operatively engaged with the peripheral surfaces of companion camming discs 130 respectively positioned on opposite sides of the eccentric disc 114 and being fixedly secured to the main driving shaft 110 and being held in spaced relation with respect to the eccentric disc by means of annular spacer members 132, as best shown in FIG. 4. The mounting arrangement as just described for the eccentric disc and associated cam discs on the main shaft 110 is an important feature of the present invention, since these elements are symmetrically arranged between the main bearings 112 in a manner such that the operating forces will be in balanced relation and shared between the main bearings so as to provide an arrangement which will reduce excessive wear and operate successfully for long periods of time.

The outermost end of the lever 122 is continuously urged in a direction to maintain engagement of the rollers 126 with the camming discs. For this purpose, a coiled compression spring 134 is mounted at the outermost end of the lever 122, one end of this spring bearing against of web 136 which extends between the side plates 128 thereof, the other end of this spring bearing against a spring supporting member 138 which extends between and has its ends secured to side walls of the tank portion 24. Thus, the configuration of the cam discs 130 is so designed that this auxillary connecting means will provide the desired overlap for the primary and secondary pumping units to the end that the discharges therefrom will be in the nature of a substantially constant delivery, as will hereinafter be described in further detail.

The driving shaft 110 is connected by conventional driving means to a suitable motor, engine, or other means, not shown, which may be connected with a suitable driven pulley 140 carried by an input shaft 142 of a conventional speed reducing mechanism 144 which has its output connected with the main shaft 110, in a manner well known in the industry.

THE VALVING MECHANISM

As will be seen by reference to FIGS. 6–9, the valving mechanism is contained within the manifold housing structure 18. The manifold housing is fabricated to provide an upper section 18*a* and a lower section 18*b*, which respectively define internal chambers 200*a* and 200*b*. The upper and lower sections are coupled together by a conventional coupling ring 202, the coupled portions of the sections coacting to clampingly engage a horizontally disposed annular seat 204 which provides a communicating passage 206 between the upper and lower chambers.

The coupled sections of the manifold housing provide a unitary assembly which is connected with the corresponding open ends of the first cylinder 40 and second cylinder 46 by means of appropriate holding lug arrangements 208 (FIG. 1) so that the lower chamber 200*b* is in communication with the open end of cylinder 40, and the upper chamber 200*a* is in communication with the open end of cylinder 46. The lower section is coupled by means of a conventional coupling ring 210 with a material source connector 212 having communication with the interior of the hopper 16. The coupled lower section 18*b* and material source connector 212 coact to clampingly engage a vertically disposed annular seat 214 which provides a communicating passage 216 between the material source connector and the lower chamber 200*b*.

A ball valve 218 in the upper chamber is operatively associated with the horizontal annular seat 204 and is normally urged into a seated position closing the communicating passage 206 by the action of gravity. Another ball valve 220 in the lower chamber is operatively associated with the vertically disposed annular seat 214 and is also normally urged by gravity forces into a seated position closing the communicating passage 216. The gravity force component acting on the valve ball 220 is obtained by supporting the ball upon an inclined surface as generally indicated by the numeral 222.

With the above arranged valving mechanism, it will be appreciated that on the suction stroke of the piston of the primary pumping unit, material will be drawn from the hopper through the communicating passage 216 into the lower manifold chamber 200*b*, and that during this action the ball valve 218 will close the communicating passage 206 to prevent reverse flow therethrough from the upper chamber. On the pumping stroke of the primary pumping unit, the pumped material will move ball valve 220 to its seated position to block flow back into the hopper, and at the same time cause the opening of the ball valve 218 to establish the communication with the upper chamber 200*a*. Material moving into the upper chamber will divide its flow, a portion going into the secondary pumping unit which is operating upon a suction stroke, while a portion will be discharged through the connection of the upper chamber with the discharge spout 20. When the secondary pumping unit operates upon its pumping stroke, the pumped material will operate to close the ball valve 218 against the horizontal annular seat and thus block reverse flow therethrough, while causing its pumped material to be discharged into the discharge spout 20 during the interim when the primary pumping is again drawing material from the hopper source.

An important feature of manifold and valve assembly resides in the accessibility to the ball valves to permit their removal for cleaning, replacement, and the like, without having to disassemble the manifold structure. For this purpose, the lower section 18*b* is constructed to provide an access opening 223 in close proximity to the vertically disposed annular seat 214, this access opening being arranged with a removably mounted closure 224 which is removably retained by holding lugs 226 having engagement with diametrically positioned slotted flanges 228, as shown in FIG. 9. The access opening 223 is of a size to permit removal of the ball valve 220 therethrough.

The extent of opening movement of the valve ball 220 is adjustable to provide compensation for pumped materials of different consistency. For this purpose, the closure 224 is provided with an axially offset stop 228 in the form of an upstanding plate member 230 having its lowermost edge welded or otherwise secured to a T-flange 232 which is secured to the closure by means of attaching bolts 234.

As shown in FIG. 7, the plate member 230 is provided with opposed arcuate edge portions 236*a* and 236*b*. As thus arranged, it will be noted that by mounting the closure 224 in alternately reversed positions, the stop 228 will be positioned at different distances from the associated vertical annular seat 214 so as to permit greater or less opening of the valve ball, as desired, depending upon the selected reversible positions of the closure.

In the case of the upper section 18*a*, access to the upper chamber 200*a* and the ball valve 218 is permitted through a discharge opening 238 having connection with the discharge spout 20. As shown, the inner end of the spout 20 is supported at one side by means of a hinge 240 of conventional construction to permit hinged swinging movement of the spout 20 from a connected position to a disconnected position. Latching means 242 is provided for releasably securing the spout in its connected position. In a disconnected position of the spout, access through the discharge opening 238 is established, this opening being of a sufficient size to permit the removal of the ball valve 218, and for cleaning purposes, etc.

An adjustable stop 244 is similarly provided for adjusting the extent of valve opening movement of the ball valve 218 in order to compensate for materials of different consistency. In this case, the stop is in the form of a vertically positioned plate member 246 which is supported by having a tapered outer end with edges respectively confined within supporting upper and lower grooves 248 and 250. The opposite end of the plate 246 is provided with angular corner edge portions 252 and 254 of lesser and greater amounts so that the plate 246 upon being alternately reversed will position the edge portion 252 or 254 with respect to the ball valve 218 at different distances so as to vary the amount of opening of the ball valve. The plate 246 is so arranged that it will not impede the hinge movement of the spout 20.

Details of the latching means 242 for releasably securing the discharge spout 20 in closed or connected position are shown in FIG. 8. The latching means includes a lengthwise adjustable link member 256 which is connectible by a clevis 258 to a fixed lug 260 on the spout 20 by means of a pivot forming bolt 262. The opposite end of link member 256 is connected by a pivot pin 264 to an intermediate point of a rocker lever member 266 which is formed at one end to provide a handle 268. The other end of the rocker lever 266 is of forked configuration with spaced legs 270 which are positioned on opposite sides of the adjacent end of link member 256 and are respectively connected by a pivot 272 to the outer ends of a clevis member 274 which carries a link 276 adapted to be placed over a hook lug 278 on the exterior of the upper section 18*a* of the manifold housing structure 18. Latching means of the type just described are well known, but have not not heretofore been utilized in the manner described for discharge spouts of cement pumping apparatus. Heretofore, the spout has benn secured in its hinged closed position by means of threadedly releasable lugs. However, the use of such lugs created a hazard, since upon being released, the built-up material pressure in the discharge spout and connected deliver line could force the spout to swing to a fully open position and discharge large quantities of material which could injure an operator. The latching means as described above provides a safety feature in that the components of the latching means are permanently interconnected in such a manner that when the lever handle 268 is swung in a counter-clockwise direction from that shown in FIG. 8, the pivots 264 and 272 will be relatively swung past a dead-center position, and the tension forces applied to the latching means will be released and permit the components to be moved to a slackened position which will permit hinged movement of the spout to a slightly opened or disconnected position which will permit relieving of the material pressure therein. After the pressure is relieved, the link 276 may be disengaged from hook lug 278, thus permitting swinging movement of the spout to a fully open or disconnected position. When it is desired to close the spout, the link 276 is engaged over the hook lug 278, and the handle 268 is swung in a clockwise direction until it assumes a full line position as shown in FIG. 8, and in reaching this position the connected parts operate to tension the connection, and in so doing the pivot pins 264 and 272 relatively are moved through a dead-center position to a position in which the lever 266 will be latched against movement.

THE OVERLAPPING OPERATION OF THE PUMPING UNITS

Figure 10:
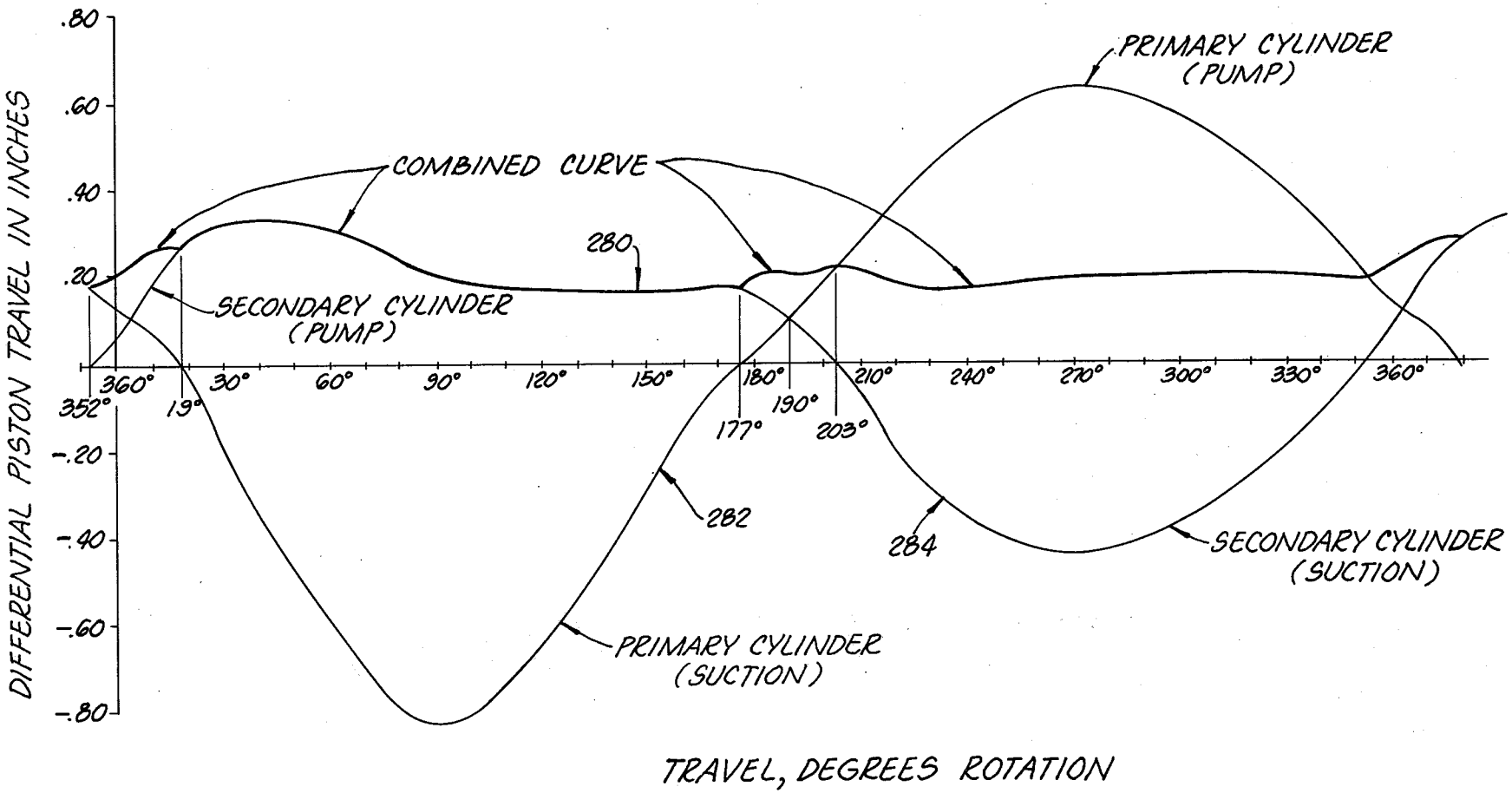
FIG. 10 is a diagram illustrating the operation of the pumping apparatus of FIG. 1.

As previously explained, the overlapping pumping actions of the primary and secondary pumping units is effected by the overriding action of the lever 122 and associated camming discs 130 upon the normal pumping operation effected by the rocker arm structure 50. This overlap and combined pumping actions of the primary and secondary pumping units is graphically illustrated by the curve as indicated by the numeral 280 in FIG. 10. Curve 282 graphically illustrates the cyclic suction and pumping action of the primary cylinder, while curve 284 indicates the suction cycle of the secondary cylinder. It will be seen particularly with reference to curve 280 that the combined discharge has a substantially constant characteristic.

Figure 11:
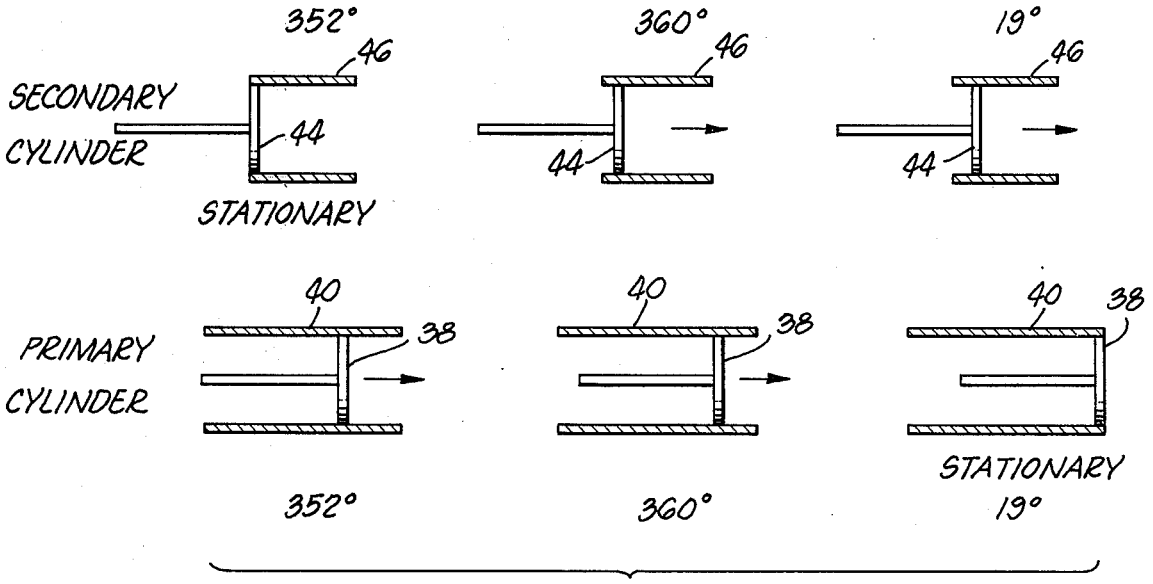
FIGS. 11 and 12 are views respectively illustrating relative positions of the operative pistons of the primary and secondary cylinders during pumping operations.
Figure 12:
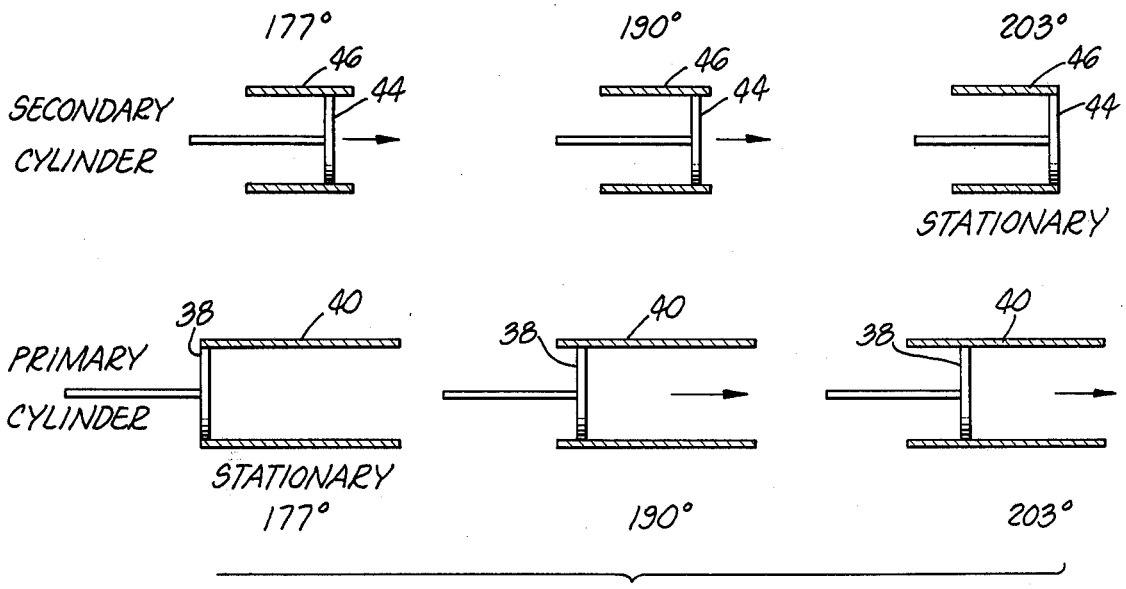

The relative piston positions of the pumping pistons of the primary and secondary cylinders during the overlap area are graphically illustrated in FIGS. 11 and 12. As shown in FIG. 11, it will be seen that at the 352° travel position, the piston 44 of the secondary cylinder 46, will be stationary, and that the piston 38 of the primary cylinder 40 will be moving towards the end of its pumping stroke. At the 360° position, the pistons of both the primary and secondary cylinders will be moving on a pumping stroke and thus jointly contribute to the discharged material being supplied to the delivery line. At the 19° position, the piston 38 of the primary cylinder 40 will have completed its pumping stroke and will be stationary, while the pumping piston 44 of the secondary cylinder 46 will be continuing with its pumping stroke. Thus, it will be seen that the discharges of the primary and secondary cylinders will be overlapped.

At the other overlapping area of operation of the primary and secondary pumping units, it will be seen from FIG. 12 that at the 177° travel position, the primary piston 38 of the primary cylinder 40 will be stationary and ready to begin its pumping stroke, while at this period the piston 44 of the secondary cylinder 46 will be moving towards the end of its pumping stroke. At the 190° position, both of the pistons will be moving in a pumping direction; and at the 203° position, the piston 44 of the secondary cylinder 46 will have reached the end of its pumping stroke and be at a stationary position, while the piston 38 of the primary cylinder 40 will be continuing with its pumping stroke.

From the foregoing description and drawings, it will be clearly evident that the delineated objects and features of the invention will be accomplished.

Various modifications may suggest themselves to those skilled in the art without departing from the spirit of my invention, and, hence, I do not wish to be restricted to the specific form or forms shown or uses mentioned, except to the extent indicated in the appended claims.

I claim:

1. Pumping apparatus for moist compressible material such as plastic, concrete, mortar, and the like, comprising:

a. a rotary driving shaft;

b. a primary pumping unit having a first cylinder and a first piston reciprocable therein;

c. a secondary pumping unit having a second cylinder and a second piston reciprocable therein, said cylinders respectively having correspondingly positioned open ends;

d. a driving connection with said shaft to actuate said pistons, including a rocker arm supported on a pivot for oscillatory movements by said shaft, said arm having one end operatively connected to said first piston and another end operatively connected to said second piston; and e. another driving connection with said shaft for overriding and modifying the piston driving action of said rocker arm and to effect overlapping discharge from said pumping units.

2. Pumping apparatus according to claim 1, which includes a pair of main shaft supporting bearings positioned respectively on opposite sides of said driving connections with said shaft.

3. Pumping apparatus according to claim 1, in which the piston of the secondary pumping unit is mounted for yielding movement in one direction from a normal position.

4. Pumping apparatus according to claim 1, in which an upright manifold housing connects the correspondingly positioned open ends of said cylinders with a pumped material discharge opening;

in which a material discharge delivery spout is hinged to said housing for movements to connected and disconnected positions in relation to said discharge opening; and in which manually releasable latching means are provided for retaining said spout in its connected position.

5. Pumping apparatus according to claim 4, in which said latching means includes parts operable upon initial release to limit the hinged disconnecting movement of said spout, whereby pressurized pumped material therein may be relieved prior to releasing said spout for hinged movement to its fully disconnected position.

6. Pumping apparatus according to claim 1, wherein said another driving connection variably shifts the pivot of said rocker arm in response to rotational movements of said driving shaft.

7. Pumping apparatus according to claim 6, in which said rocker arm pivot is supported upon a swingable lever; and in which one end of said lever is connected by said another driving connection with said shaft for oscillatory swinging movement in response to said shaft rotation.

8. Pumping apparatus according to claim 7, in which said connection between said one lever end and said shaft comprises camming means.

9. Pumping apparatus according to claim 8, in which said camming means comprises at least one rotatable cam carried by said shaft and a cam follower carried by one end of said lever.

10. Pumping apparatus according to claim 8, in which said one end of said lever is operatively connected with said shaft through a pair of spaced cam members on said shaft;

in which said rocker arm is operatively connected with said shaft through eccentric means including an eccentric disc mounted on the shaft between said cam members; and in which said shaft is rotatably supported in a pair of main bearings positioned respectively outwardly on opposite sides of the cam members.

11. Pumping apparatus according to claim 10, in which said lever has laterally spaced side plates which support rollers at one end for engagement with said cam members;

in which said rocker arm comprises a pair of similar spaced apart side plate members of triangular configuration positioned between and supported on said lever side plates for pivotal rocking movement; and in which said eccentric disc is operatively associated with a connecting rod having one end pivotably connected with and positioned between the rocker arm side plates.

12. Pumping apparatus according to claim 11, which includes spring means for urging said lever in a direction to maintain said rollers in engagement with said cams.

13. Pumping apparatus according to claim 1, in which an upright manifold housing connects the correspondingly positioned open ends of said cylinders with a pumped material discharge opening;

in which said manifold housing comprises an upper chamber in communication with the open end of said second cylinder and said discharge opening;

a lower chamber having communication with the upper chamber and with the open end of said first cylinder and said supply source;

in which valve members respectively in the upper and lower chambers control the flow of material between the supply source and said lower chamber, and between the lower chamber and the upper chamber; and in which a material discharge delivery spout is supported on the manifold housing for connection and disconnection with respect to said upper chamber; said spout, when disconnected, providing an access opening to the upper chamber through which the valve therein may be removed.

14. Pumping means according to claim 13, in which a stop member for the valve in the upper chamber is mounted on the inner end of said delivery spout.

15. Pumping means according to claim 14, wherein the stop member comprises an edgewise reversible plate member having valve abutting stop surfaces positioned at different distances from said horizontally positioned valve respective edgewise reversed positions of the plate.

16. Pumping means according to claim 13, in which a removably mounted closure provides access to said lower chamber, for removal of the valve member therein.

17. Pumping means according to claim 16, in which a stop member for the valve in the lower chamber is mounted on said closure.

18. Pumping means according to claim 17, wherein the closure is arranged for reversible mounting; and in which the stop member comprises an upstanding plate member having valve abutting stop surfaces positioned at different distances from said vertical positioned valve seat, when said closure is selectively reversed with respect to its mounting position.

* * * * *